United States Patent [19]

Fuhrmann

[11] 3,993,937

[45] Nov. 23, 1976

[54] CIRCUIT FOR INCREASING THE IMPEDANCE OF A WINDING WOUND AROUND TWO CORES MADE OF SOFT MAGNETIC MATERIAL

[75] Inventor: Bruno Fuhrmann, Braunschweig, Germany

[73] Assignee: Felten & Guilleaume Carlswerk AG, Cologne, Germany

[22] Filed: May 9, 1975

[21] Appl. No.: 579,865

[30] Foreign Application Priority Data

May 9, 1974 Germany ..... 2422436

[52] U.S. Cl. ..... 317/123; 323/44 R; 336/212

[51] Int. Cl.[2] ..... H01F 27/24

[58] Field of Search ..... 317/123; 330/157, 165, 330/167; 336/212, 220; 323/44 R, 45

[56] References Cited

UNITED STATES PATENTS 3,316,504 4/1967 Rockwell ..... 330/167 UX 3,489,955 1/1970 Freeborn ..... 317/123

*Primary Examiner*—R. N. Envall, Jr.

*Attorney, Agent, or Firm*—Michael J. Striker

[57] ABSTRACT

A principal winding is wound around two cores made of soft magnetic material. The principal winding has N turns. Wound around only one of the two cores is a magnetizing winding. A decoupling amplifier of gain $v_1$ energizes the magnetizing winding via the amplifier output, and the amplifier has an input across which is applied the voltage across the principal winding. The magnetizing winding has $v_1$.N turns. If the principal winding and the magnetizing winding have the same winding direction, then the gain of the decoupling amplifier is chosen positive. If the principal winding and the magnetizing winding have opposite winding directions, then the gain of the decoupling amplifier is chosen negative.

13 Claims, 9 Drawing Figures

CIRCUIT FOR INCREASING THE IMPEDANCE OF A WINDING WOUND AROUND TWO CORES MADE OF SOFT MAGNETIC MATERIAL

BACKGROUND OF THE INVENTION

The invention relates to a circuif for increasing the impedance of a winding which is wound around two cores of soft magnetic material.

In communications and measurement technology, use is frequently made of autotransformers and isolating transformers operative for stepping down or stepping up an alternating voltage, with it being desired that the step-down or step-up ratio be determined as exactly as possible by the winding ratio of the transformer. To meet this requirement, it is necessary to use transformers having a very high principal impedance compared to the ohmic winding resistances and stray impedances. This high principal impedance is also necessary in order to keep low the errors attributable to loading of the AC voltage source or to resistive or other voltage drops on the supply lines.

Additionally, there is considerable interest in inductors of high inductance and relatively small size, and also in inductors whose inductance can be varied by electronic means over several order of magnitude (powers of ten).

For transformers which are to serve as very high-precision inductive voltage dividers or matching transformers, the ratio of principal impedance to the winding resistances and stray impedances which can be achieved using conventional soft magnetic core materials is too low. Furthermore, due to the low principal impedance, the magnetizing current of the transformer loads the AC voltage source connected to the transformer and produces undesired voltage drops on the supply lines. This is particularly the case in the low-frequency range.

In general, inductors of very high inductance can be made using known core materials only by employing a large number of winding turns. However, that expedient results in a high ohmic winding resistance and poor quality of the finished inductor.

In the aforementioned cases, improvements can be achieved only by resort to electronic means. Gibbings (D. L. H. Gibbings, "Circuit for Reducing the Exciting Current of Inductive Devices," Proc. IEE. vol. 108 B, 1961, pp. 339–343) has disclosed a circuit for increasing the impedance and reducing the magnetizing current of a winding which is wound around two cores of soft magnetic material. With this circuit, there is provided on one of the cores an indicator winding the voltage across which is amplified by an electronic amplifier and then applied to a magnetizing winding on the other of the cores. In this way, Gibbings causes a great part of the magnetic flux to be established by the electronic amplifier, with only a relatively small magnetizing current flowing in the winding around the two cores and serving to establish a magnetic flux in the core around which the indicator winding is wound. The reduction in the magnetizing current achieved with this circuit is limited particularly at low and high frequencies, since at such frequencies one is in effect dealing with a two-transformer feedback circuit in which the gain of the amplifier, to stabilize against self-excitation, must not be selected too high and furthermore must drop off in direction towards low frequencies and also in direction towards higher frequencies.

SUMMARY OF THE INVENTION

It is a general object of the invention to increase over a wide frequency range the impedance of a winding having two cores made of soft magnetic material and, to the extent that an extreme increase of several orders of magnitude (powers of ten) is not desired, using only a single auxiliary winding on one of the two cores.

According to one advantageous concept of the invention, this object is achieved by providing one core of soft magnetic material with a magneizing winding and providing one or more principal windings which are wound around such one core and also around a further core made of soft magnetic material. The voltage across one of the principal windings is applied to the input of a high-input-impedance electronic decoupling amplifier the output of which is connected to and energizes the magnetizing winding. The polarity (sign) of the amplifier gain and the winding directions of the principal winding and of the magnetizing winding must be so chosen that the alternating magnetic flux established by the magnetizing winding and by the output current of the amplifier is substantially in phase with that established by the principal winding. If the principal winding connected to the decoupling amplifier has N turns and the amplifier has a gain $v_1$, then the magnetizing winding should have $v_1$.N turns. In such event, the predominant portion of the alternating magnetic flux needed for the principal winding is created by the decoupling amplifier and by the magnetizing winding. Due to the voltage drops attributable to the ohmic winding resistance and the stray inductance of the magnetizing winding, the magnetic flux established by the amplifier is somewhat less than would be necessary for a given voltage across one of the principal windings. This difference in flux produces small magnetizing currents in the principal windings, but these are significantly smaller than would be the case without the amplifier and without the magnetizing winding. Markedly reduced magnetizing currents signify a considerable increase in the impedance of the principal windings.

With this simple circuit expedient, the stray inductance and ohmic resistance of the magnetizing winding places an upper limit upon the increase of the impedance of the principal winding or windings. The influence of these two quantities upon the winding impedance increase can be decreased using supplemental circuitry.

In its simplest form this supplemental circuitry includes an impedance Z, connected in series with the magnetizing winding, and composed of the series connection of a resistor and an inductor. The voltage drop produced by the magnetizing current across this impedance is amplified and added to the voltage supplied to the magnetizing winding. In this way, the voltage drop across the magnetizing winding can be increased by the amount of the voltage drop attributable to the ohmic resistance and the stray inductance of the magnetizing winding, and there is thus produced in the second core a magnetic flux sufficient to eliminate the need for any supplemental flux to be established in the first core by the principal winding, and so the magnetizing currents in the principal winding can be brought down to zero.

By providing an indicator winding on the core which is provided with the magnetizing winding, it becomes possible to decrease the influence of the ohmic winding resistance and stray inductance of the magnetizing winding in additional ways.

The voltage across this indicator winding, according to one concept of the invention, is compared with the voltage across the principal winding, and the voltage difference after amplification by a factor $v$ is added to the supply voltage of the magnetizing winding. In such case, the principal winding and the indicator winding should have the same number of turns. The differnce between the voltage across the principle winding and the voltage across the indicator winding is a measure of the magnetic flux still to be established by the principal winding; it can be made small by selecting a correspondingly high gain $v$, so that the magnetizing current in the principle winding will be extremely small.

According to another concept of the invention, the voltage across the indicator winding is compared with the output voltage of the decoupling amplifier and the resulting difference voltage, after amplification by a gain factor $v$, is added to the supply voltage for the magnetizing winding. In such case, the indicator winding and the magnetizing winding should have the same number of turns. With this circuit expedient, the influence of the ohmic winding resistance and stray inductance of the magnetizing winding is reduced by the factor $v$.

One important advantage of the invention is that there is achieved a significant reduction of the magnetizing current in the principal winding, and accordingly the input impedance of the winding is made higher. If the inventive circuit expedients are applied to inductive voltage dividers or matching transformers, then in correspondence to the reduction of the magnetizing current there is a decrease in the transmission errors resulting from the voltage drops produced by the magnetizing currents across the ohmic winding resistances and stray inductances.

As a result of the high input impedance of the windings, there is additionally a decrease in the errors attributable to the supply line impedances and the loading of the voltage source connected to the inductor.

The ratio of turns-number and core dimensions to winding impedance decreases significantly, so that given input impedances can be achieved with smaller cores and fewer turns. There results from this a decrease in ohmic winding resistance, stray inductance and winding capacitance, which at the same time causes an increase in the bandwidth of the transformer. The reduction of the ohmic winding resistance is particularly important in the case of matching transformers used at low frequencies with null indicators, since with conventional transformers the noisy ohmic winding resistances raise up again the signal-to-noise ratio.

A further advantage of the invention is that very high inductance values can be realized with inductors of small dimensions and low turns-numbers. Another advantage is that the inductance values can be made variable over several orders of magnitude (powers of ten) by using variable-gain electronic amplifiers.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
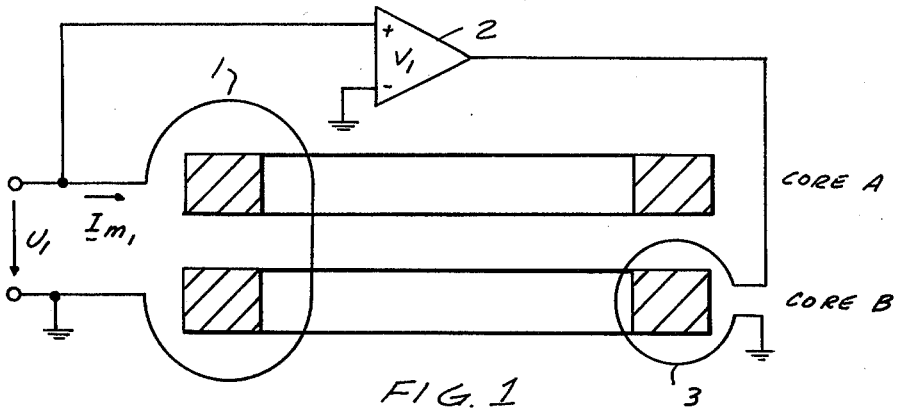
FIG. 1 illustrates the expedient of increasing the impedance of the principal winding 1 by energizing the magnetizing winding 3 from the output of the decoupling amplifier 2.

In FIG. 1, the principal winding 1 is wound around the cores A and B, ring cores in this embodiment, and wound around only core B is a magnetizing winding 3. For the sake of simplicity, the principal winding and the magnetizing winding are each depicted as consisting of a single turn, although it will be understood that in general each will consist of a plurality of turns. The voltage across the principal winding 1, which has N turns, is applied to the input of a high input-impedance decoupling amplifier 2 having a gain $v_1$. The magnetizing winding 3, having $v_1$.N turns, is energized from the output of the amplifier 2. Because the amplifier 2 here employed is a non-inverting amplifier, the principal winding 1 and the magnetizing winding 3 have the same winding directions. If the amplifier 2 were an inverting amplifier, then the principal winding 1 and the magnetizing winding 3 would have opposite winding directions.

If $Z_1$ is the impedance of a winding of N turns wound around core A, $Z_2$ the impedance of a winding of N turns wound around core B, and $R_s$ and $L_s$ the ohmic resistance and stray inductance of the magnetizing winding 3, then the complex impedance $Z_w$ of the principal winding 1, whose stray inductance and ohmic resistance are negligible, can be computed from the following equation:

$$Z = \frac{U_1}{I_{m1}} = Z_1 + Z_2 + Z_1 \frac{v_1^2 Z_2}{R_s + j\omega L_s} \quad (1)$$

The impedance of the principal winding 1 is increased by the term $$Z_1 \frac{v_1^2 Z_2}{R_s + j\omega L_s}.$$

This term increases if $R_s$ and $L_s$ decrease.

Figure 2:
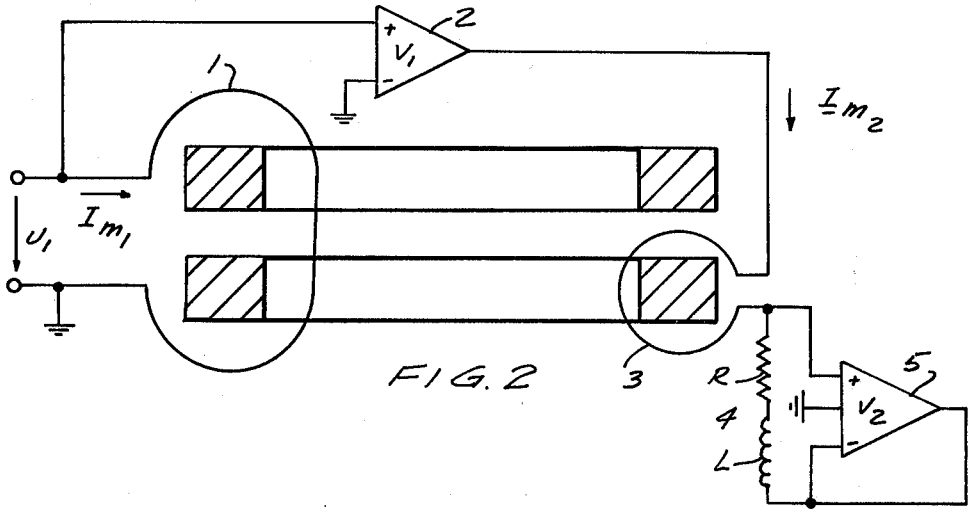
FIG. 2 illustrates the expedient of FIG. 1, and the expedient of further decreasing the influence of the ohmic resistance and stray inductance of the magnetizing winding by connecting in series with the latter a complex impedance Z and by deriving a corrective voltage using a difference amplifier 5.

In FIG. 2 there is depicted a circuit expedient according to which electronic means are employed to reduce the influence of the ohmic resistance $R_s$ and stray inductance $L_s$ of the magnetizing winding 3.

For this purpose, there is connected in series with the magnetizing winding 3 a complex impedance Z composed of the series connection 4 of a resistance R and an inductance L. The voltage drop across this impedance Z is applied to a difference amplifier 5 having a gain $v_2$ the output of which is connected to the lower terminal of the impedance Z, the voltage appearing at the output of amplifier 5 being $-v_2 I_{m2}(R+j\omega L)$.

With the quantities below being defined the same as for equation (1), the impedance of the principal winding 1 is computed from the following equation:

$$Z = \frac{U_1}{I_{m1}} = Z_1 + Z_2 + Z_1 \frac{v_1^2 Z_2}{(R_s+j\omega L_s)-(-1+v_2)(R+j\omega L)} \quad (2)$$

In the event that $$R + J\omega L = \frac{R_s + j\omega L_s}{v_2 - 1} \quad (3)$$

then the impedance $Z_w$ of the principal winding 1 would become infinite. Smaller increases of the impedance are achieved by making $R+j\omega L$ smaller than required by equation (3). It is furthermore possible to decrease the denominator in the last term in equation (2), to thereby increase the impedance $Z_w$ of the principal winding 1, by making $R+j\omega L$ and $R_s+j\omega L_s$ of different phase angles, which results in a phase angle change of the complex impedance $Z_w$ of the principal winding 1. In the extreme case, one can limit oneself to increasing the impedance $Z_w$ by reducing the influence of only the stray inductor else only the ohmic winding resistance by making R or L zero. In general, any increase in the value of the last term in equation (2) will serve to increase the impedance $Z_w$ of the principal winding 1.

Figure 3:
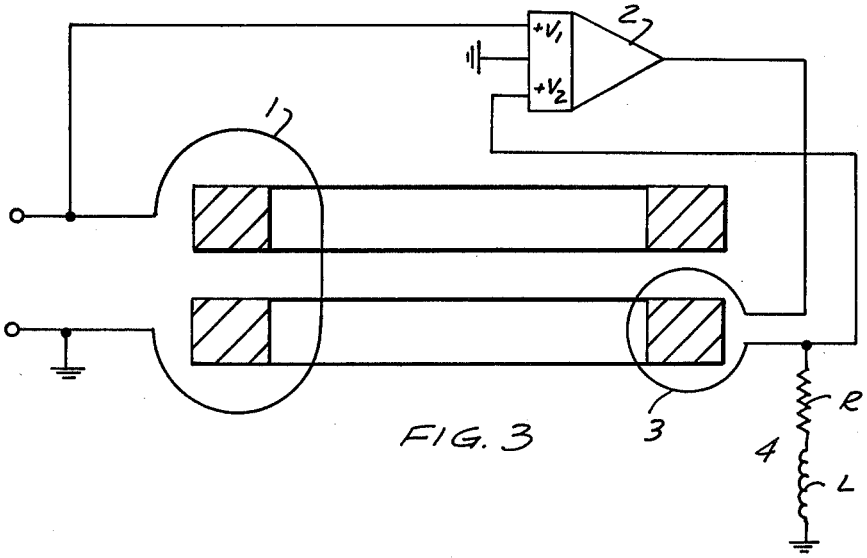
FIG. 3 illustrates the expedient of FIG. 2, but using for the decoupling amplifier 2 a summing amplifier which absorbs the function of the difference amplifier 5 in FIG. 2.

FIG. 3 depicts another way of implementing the concept of FIG. 2. In FIG. 3, the decoupling amplifier 2 has the form of a summing amplifier having two inputs. Corresponding to the expedient of FIG. 2, in FIG. 3 the voltage across the principal winding 1 is applied across the input of amplifier 2 associated with the gain $+v_1$. Additionally, the voltage drop across the impedance Z, which is composed of the series connection 4 of the resistance R and inductance L, is applied across the input of amplifier 2 associated with the gain $+v_2$. In this way, the summing amplifier 2 of FIG. 3 absorbs the function of the difference amplifier 5 in FIG. 2.

Figure 4:
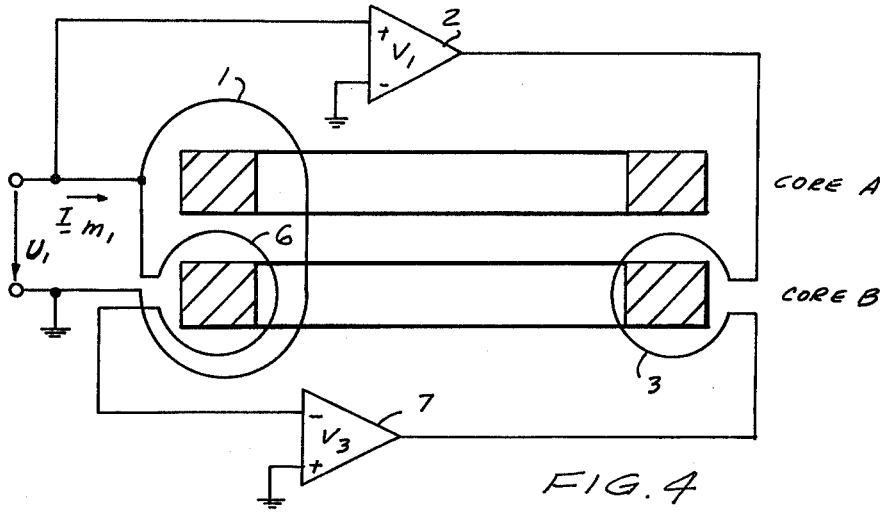
FIG. 4 illustrates the expedient of FIG. 1, and the expedient of further decreasing the influence of the ohmic resistance and stray inductance of the magnetizing winding by using an indicator winding 6 and an auxiliary amplifier 7.

FIG. 4 depicts another way of reducing the influence of the ohmic resistance and stray inductance of the magnetizing winding and reducing the effect of fluctuations in the gain $v_1$. The principal winding 1, having N turns, is wound around both core A and core B. Wound around core B is not only the magnetizing winding 3, having $v_1$.N turns, but also an indicator winding 6 having N turns. One terminal of indicator winding 6 is connected to the same phase terminal of principal winding 1, whereas the other terminal of indicator winding 6 is connected to the inverting input of the auxiliary amplifier 7. The auxiliary amplifier 7 amplifies, with a gain $v_3$, the difference between the voltage $U_1$ across principal winding 1 and the voltage induced in the indicator winding 6. The magnetizing winding 3 is energized via the outputs of the auxiliary amplifier 7 and the decoupling amplifier 2.

In FIG. 4, if the winding directions of the principal winding 1 and of the magnetizing winding 3 are the same, then the auxiliary amplifier 7 is an inverting amplifier, as shown; on the other hand, if the winding directions of windings 1 and 3 are opposite, then a non-inverting amplifier is used as the auxiliary amplifier 7.

With the quantities below being defined the same as for equation (1), the impedance $Z_w$ of the principal winding 1 can be computed from the following equation:

$$Z = Z_1 + Z_2 + \frac{(v_1^2 + v_1 v_3) Z_1 Z_2}{R_s + j\omega L_s} \quad (4)$$

The numerator of the fraction has been increased, relative to the corresponding numerator in equation (1), by the summand $v_1 v_3 Z_1 Z_2$, resulting in an increase in the impedance $Z_w$ of the principal winding 1.

Figure 5:
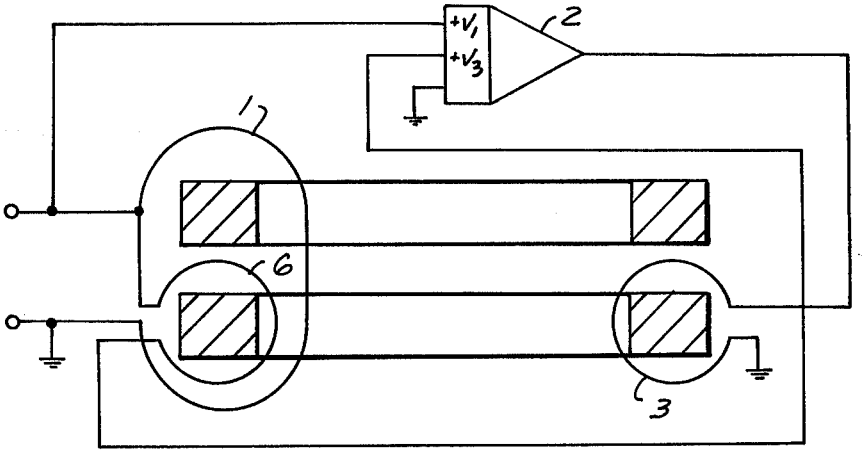
FIG. 5 illustrates the expedient of FIG. 4, but using for the decoupling amplifier a summing amplifier 2 which absorbs the function of the difference amplifier 7 of FIG. 4.

In FIG. 5, the concept of FIG. 4 is realized in a different way. In FIG. 5, the decoupling amplifier 2 is provided in the form of a summing amplifier, so as to absorb the function of the auxiliary amplifier 7 of FIG. 4.

In FIG. 5, as in FIG. 4, the upper terminal of indicator winding 6 is connected to the same-phase terminal of principal winding 1. If windings 1 and 3 have the same winding directions, then the gain factors $v_1$ and $v_3$ are both positive, as indicated in the drawing; if windings 1 and 3 have opposite winding directions, then the gain factors $v_1$ and $v_3$ would both be negative.

Figure 6:
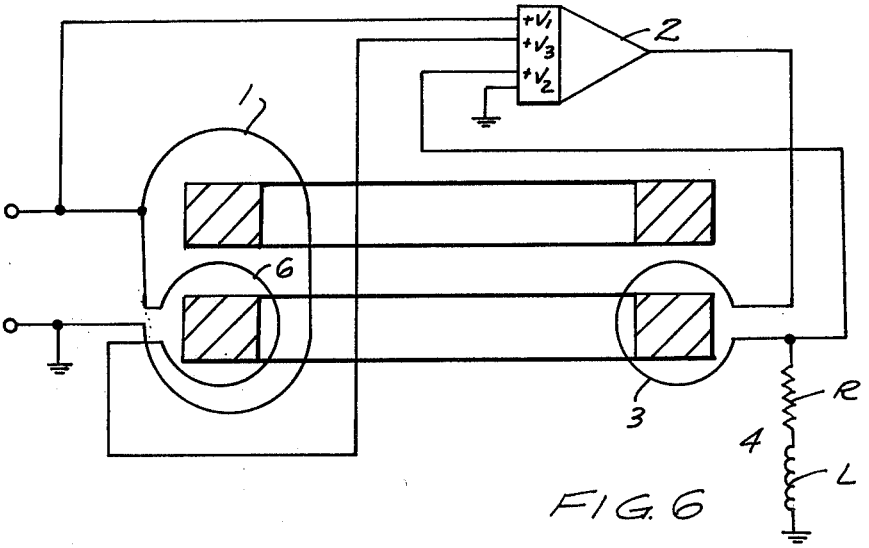
FIG. 6 illustrates the expedient of FIG. 5, and the additional use of an impedance Z connected in series with the magnetizing winding, as well as the use for the decoupling amplifier of a summing amplifier having 3 inputs.

In FIG. 6, in addition to the expedient of FIG. 5, there is achieved a reduction of the influence of the ohmic resistance and stray inductance of the magnetizing winding 3, by using the expedient of FIG. 3. The combination of these two expedients may be necessary for the purpose of very greatly increasing the impedance of the principal winding 1, for example when, for reasons involving the D.C. stability of the circuit, the amplifier gains cannot be made arbitrarily high, i.e., so that neither the expedient of FIG. 3 nor the expedient of FIG. 5 can be exploited to the fullest possible extent.

Figure 7:
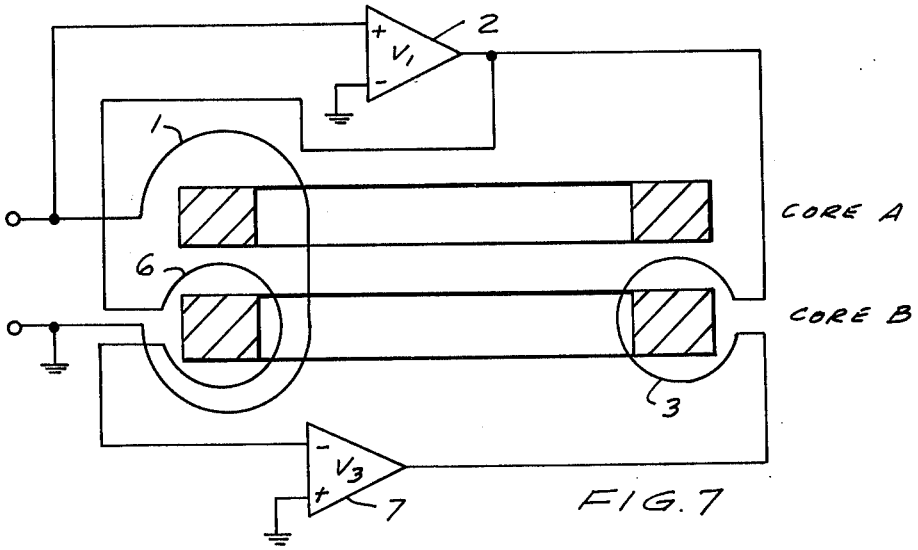
FIG. 7 illustrates the expedient of FIG. 1, and the expedient of further decreasing the influence of the ohmic winding resistance and stray inductance of the magnetizing winding by using an indicator winding and an auxiliary amplifier connected to the output of the decoupling amplifier.
Figure 8:
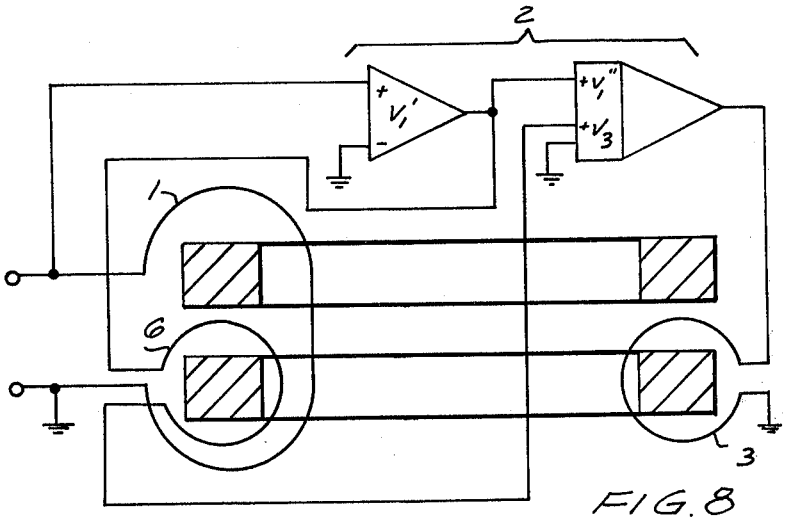
FIG. 8 illustrates the expedient of FIG. 7, but using for the decoupling amplifier a stage composed of a preamplifier and a summing amplifier.
Figure 9:
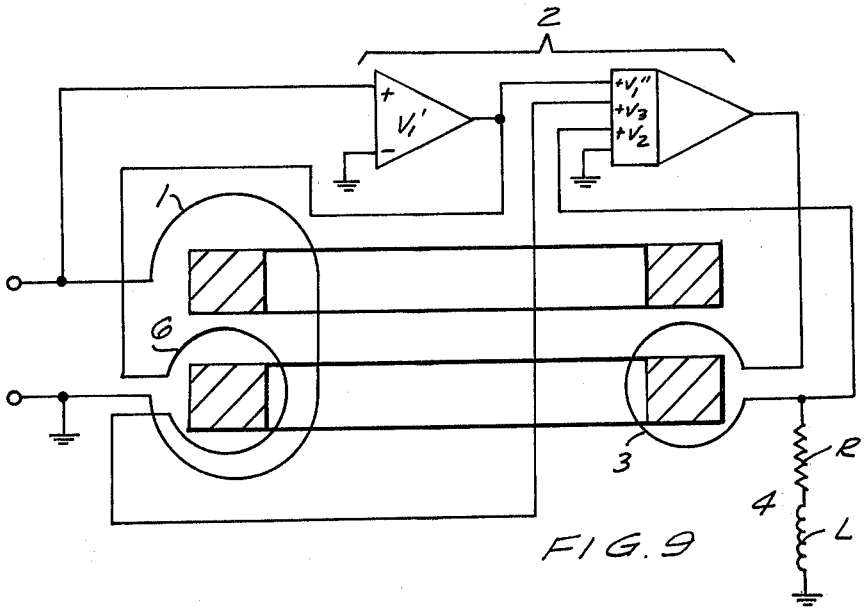
FIG. 9 illustrates the expedient of FIG. 8, with the additional use of a complex impedance Z in series with the magnetizing winding and with the use of a summing amplifier having three inputs.

The circuits in FIGS. 7–9 correspond in their operation to those in FIGS. 4–6, but with the difference that in FIGS. 7–9 the comparison signal for the indicator winding 6 is tapped off at the output of the decoupling amplifier or at the output of the pre-amplifier of the decoupling amplifier stage. In this way, the effect of fluctuations of the gain of the decoupling amplifier or of the preamplifier of the decoupling amplifier stage is not reduced as in the corresponding circuits of FIGS. 4–6. Advantageously, however, the isolation of the indicator winding 6 and the input impedance of the auxiliary amplifier does not have any significant effect upon the impedance of the principal winding 1.

In FIG. 7, the indicator winding 6 has $v_1.N$ turns; one of its ends is connected to the same-phase output of decoupling amplifier 2, while its other terminal is connected to the input of an auxiliary amplifier 7. If the principal winding 1 and magnetizing winding 3 have the same winding directions, the auxiliary amplifier 7 is an inverting amplifier, as shown in the drawing; if the windings 1 and 3 have opposite winding directions, the auxiliary amplifier 7 is made a non-inverting amplifier.

In FIG. 8, the magnetizing winding 3 has $v_1'.v_1''.N$ turns, and the indicator winding 6 has $V_1'.N$ turns, where where N is the number of turns of the principal winding 1. One terminal of the indicator winding 6 is connected with the same-phase output of the pre-amplifier, and its other terminal is connected to the $+v_3$ input of the summing amplifier. If the winding directions of windings 1 and 3 are the same, then the product of the gain factors $v_1'$ and $v_2''$ is positive; if the winding directions of windings 1 and 3 are opposite, then the product of $v_1'$ and $v_2''$ is negative. The gain factors $v_1''$ and $v_3$ have the same sign.

With the circuits of FIGS. 1–9, the impedance and accordingly the inductance of the principal winding 1 can be varied over several orders of magnitude (powers of ten), by varying the respective gains of the decoupling amplifiers and of the pre-amplifiers of the decoupling amplifier stages. Accordingly, it is to be understood that in each of FIGS. 1–9 each gain is advantageously adjustable, and indpendently of every other gain in the respective circuit when more than one gain is involved in the respective circuit.

In the embodiments of FIGS. 2, 3, 6 and 9, wherein use is made of the complex impedance Z consisting of the series connection 4 of a resistance R and an inductance L, as explained with reference to FIG. 2, $$Z \leqq \frac{R_s + j\omega L_s}{v_2 - 1}$$

where $v_2$ is the gain factor applied to the voltage drop across this complex impedance Z. It will be understood that in the inequality just above it is the magnitudes of the complex numbers on the two sides of the inequality sign which are being compared.

It will be understood that each of the elements described above, or two or more together, may also find a useful application in other types of circuits and constructions differing from the types described above. p While the invention has been illustrated and described as embodied in an inductor wound around two coaxial ring cores, with associated electronic impedance-modifying circuitry, it is not intended to be limited to the details shown, since various modifications and structural changes may be made without departing in any way from the spirit of the present invention.

For example, in the foregoing discussion, where the number of turns of different windings was indicated, it should be understood that other numbers of turns, although in some instances less advantageous, would still afford an increase in the principal winding impedance, and accordingly still be within the scope of the invention. For example, with respect to FIG. 1, it was indicated that the magnetizing winding 3 should have $v_1$.N turns, where N is the number of turns of the principal winding 1 and where $v_1$ is the gain of decoupling amplifier 2. This selection of turns-numbers will indeed result in reduction to zero of the magnetizing current in the principal winding, assuming for the sake of simplicity that the ohmic resistance and stray inductance of both the principal winding 1 and of the magnetizing winding 3 can be ignored. However, if the magnetizing winding 3 has fewer than $v_1$.N turns, the result will be merely that the magnetizing current in the principal winding 1 will not be reduced as greatly as otherwise possible.

Likewise, with respect to FIG. 4, for example, it was stated that the indicator winding 6 should have the same number of turns as the principal winding 1. This is indeed particularly advantageous because the desired corrective voltage for compensating against the ohmic resistance and stray inductance of the magnetizing winding 3 can be simply formed by subtracting from the voltage across the principal winding 1 the voltage induced across the indicator winding 6, without the use of special electronic subtracting circuits, or the like. However, if for example the indicator winding 6 had only half the number of turns of principal winding 1, then it would be possible, inter alia, to use an electronic amplifier to double the voltage induced across the indicator winding 6 before subtracting such voltage from the voltage across the principal winding 1 and applying the resulting difference to the inverting amplifier 7.

Similar comments can be made with respect to the turns-number ratios which can be employed in the other embodiments.

In the foregoing description, for example with respect to FIG. 1, it has been indicated that the input impedance of the decoupling amplifier 2 is high. In this context, it will be understood that the input impedance of decoupling amplifier 2, and its counterparts in the embodiments of FIGS. 2–9, is high relative to the impedance established for the principal winding 1 in the assembled circuit. In particular, if the input impedance of decoupling amplifier 2 is high relative to the impedance of principal winding 1, then the current supplied by the (non-illustrated) alternating voltage source will flow almost exclusively into the primary winding 1, and very little will be diverted into the input circuitry of the decoupling amplifier 2. Accordingly, the input impedance of decoupling amplifier 2 is advantageously one or more orders of magnitude greater than the impedance of principal winding 1, for example about ten, one hundred, one thousand, or ten thousand times greater.

The same applies to the input impedance of the pre-amplifiers of the decoupling amplifier stages 2 in FIGS. 7 and 8 and of the other amplifiers having an input connected to the non-grounded terminal of principal winding 1.

In the Figures, there is illustrated only a single principal winding 1, shown for simplicity as consisting of one turn. Besides the fact that the principal winding can consist of more than one turn, more than one principal winding can be used, all wound around both ring cores, but with for example only one being connected across the decoupling amplifier or decoupling amplifier stage in the manner shown and discussed above.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A high-impedance low-ohmic-resistance inductor comprising, in combination, a first magnetic core and a second magnetic core; a principal winding wound around both cores, the principal winding having N turns; a magnetizing winding having $v_1$.N turns wound around only one of the magnetic cores; and a high input impedance decoupling amplifier of gain $v_1$, the amplifier having its input connected to receive the terminal voltage of the principal winding, the amplifier having its output connected to the magnetizing winding for energizing the latter in dependence upon the terminal voltage of the principal winding, the amplifier gain factor $v_1$ being positive if the winding directions of the principal winding and magnetizing winding are the same and negative if the winding directions are opposite.

2. The inductor defined in claim 1, the magnetizing winding having an ohmic resistance $R_s$ and a stray inductance $L_s$, and further including means for at least partly compensating for the ohmic resistance and stray inductance of the magnetizing winding, the compensating means including an impedance Z comprised of a series resistance and inductance connecting the magnetizing winding to a circuit reference potential, a difference amplifier having a gain of $-v_2$, the input of the difference amplifier being connected to the impedance Z to receive as input voltage the voltage drop across the impedance Z, the output of the difference amplifier being connected to that terminal of the impedance Z not connected to the magnetizing winding, the impedance Z being determined by the equation $$Z \leqslant \frac{R_s + j\omega L_s}{v_2 - 1}.$$

3. The inductor defined in claim 1, the magnetizing winding having an ohmic resistance $R_s$ and a stray inductance $L_s$, the decoupling amplifier being a summing amplifier having besides the input associated with the gain $v_1$ a further input associated with a gain of $v_2$, and further including means for at least partly compensating for the ohmic resistance and stray inductance of the magnetizing winding, the compensating means including an impedance Z comprised of a resistance and inductance connected in series with the magnetizing winding, the input of the summing amplifier associated with the gain of $v_2$ being connected to the impedance Z to receive as its input signal the voltage drop across the impedance Z, the impedance Z being determined by the equation $$Z \leqslant \frac{R_s + j\omega L_s}{v_2 - 1}.$$

4. The inductor defined in claim 1, further including an auxiliary amplifier, further including an indicator winding having N turns wound around that one of the magnetic cores around which is wound the magnetizing winding, the indicator having one terminal connected to the same-phase terminal of the primary winding and having its other terminal connected to the input of the auxiliary amplifier, the magnetizing winding being connected between the output of the decoupling amplifier and the output of the indicator winding, the auxiliary amplifier being an inverting amplifier if the principal and magnetizing windings have the same winding direction and being a non-inverting amplifier if the principal and magnetizing windings have opposite winding directions.

5. The inductor defined in claim 1, the decoupling amplifier being a summing amplifier having besides the input associated with the gain $v_1$ a further input associated with a gain of $v_3$, further including an indicator winding having N time wound around that one of the magnetic cores around which is wound the magnetizing winding, the indicator winding having one terminal connected to the same-phase terminal of the primary winding and having its other terminal connected to that input of the summing amplifier associated with the gain of $v_3$, the gains $v_1$ and $v_3$ being positive if the principal and magnetizing windings have the same winding direction and negative if the principal and magnetizing windings have opposite winding directions.

6. The inductor defined in claim 5, the magnetizing winding having an ohmic resistance $R_s$ and a stray inductance $L_s$, the summing amplifier having a further input associated with a gain of $+v_2$, further including means for at least partly compensating for the ohmic resistance and stray inductance of the magnetizing winding, the compensating means including an impedance Z comprised of a series resistance and inductance connecting the magnetizing winding to a circuit reference potential, the summing amplifier input associated with the gain of $+v_2$ being connected to the impedance Z to receive as its input signal the voltage drop across the impedance Z, the impedance Z being determined by the equation $$Z \leqslant \frac{R_s + j\omega L_s}{v_2 - 1}.$$

7. The inductor defined in claim 1, further including an auxiliary amplifier, further including an indicator winding having $v_1$.N turns wound around that one of the magnetic cores around which is wound the magnetizing winding, one terminal of the indicator winding being connected to the same-phase terminal of the primary winding, the other terminal of the indicator winding being connected to the input of the auxiliary amplifier, the magnetizing winding being connected between the output of the decoupling amplifier and the output of the auxiliary amplifier, the auxiliary amplifier being an inverting amplifier if the winding directions of the principal and magnetizing windings are the same and a non-inverting amplifier if the principal and magnetizing windings have opposite winding directions.

8. The inductor defined in claim 1, the decoupling amplifier being comprised of a high input impedance input amplifier of gain $v_1'$ and a summing amplifier, the summing amplifier having one input associated with a gain of $v_1''$ and a further input associated with a gain of $v_3$, the output of the input amplifier of gain $v_1'$ being connected to the summing amplifier input associated with the gain of $v_1''$, $v_1$ being equal to $v_1'$ multiplied by $v_1''$ and the magnetizing winding having $v_1'.v_1''$.N turns, further including an indicator winding having $v_1'$.N turns wound around the one of the magnetic cores around which is wound the magnetizing winding, one terminal of the indicator winding being connected to the same-phase terminal of the principal winding and the other terminal of the indicator winding being connected to the summing amplifier input associated with the gain of $v_3$, the product of the gains $v_1'$ and $v_1''$ being positive if the winding directions of the primary and magnetizing windings are the same and negative if the primary and magnetizing windings have opposite winding directions, the sign of the gains $v_1''$ and $v_3$ being the same.

9. The inductor defined in claim 8, the magnetizing winding having an ohmic resistance $R_s$ and a stray inductance $L_s$, the summing amplifier having a further input associated with a gain of $+v_2$, further including means for at least partly compensating for the ohmic resistance and stray inductance of the magnetizing winding, the compensating means including an impedance Z comprised of a series resistance and inductance connecting the magnetizing winding to a circuit reference potential, the summing amplifier input associated with the gain of $+v_2$ being connected to the impedance Z to receive as an input signal the voltage drop across the impedance Z, the impedance Z being determined by the equation $$Z \leq \frac{R_s + j\omega L_s}{v_2 - 1}.$$

10. The inductor defined in claim 1, the inductor including further windings wound around both magnetic cores in addition to the principal winding.

11. The inductor defined in claim 1, the gain of the decoupling amplifier being adjustable.

12. The inductor defined in claim 3, the gains of the summing amplifier being adjustable.

13. The inductor defined in claim 4, the gain of the auxiliary amplifier being adjustable.

* * * * *